United States Patent [19]

Suwala et al.

[11] 4,378,272

[45] Mar. 29, 1983

[54] WATER PURIFYING LATEX BINDER

[75] Inventors: David W. Suwala, Flanders, N.J.; Crowley C. Allen, Jr., Durham, N.C.; Ulrich W. Kempf, Emmaus, Pa.

[73] Assignee: GAF Corporation, New York, N.Y.

[21] Appl. No.: 276,769

[22] Filed: Jun. 24, 1981

[51] Int. Cl.[3] ..... D21H 5/18; D21D 3/00

[52] U.S. Cl. ..... 162/152; 162/155; 162/156; 162/169; 162/190

[58] Field of Search ..... 162/169, 145, 155, 190, 162/152, 156, 168.1; 524/819, 821, 828; 526/201; 210/681, 688, 732–734, 725, 728, 928

[56] References Cited

U.S. PATENT DOCUMENTS

| | | | |
|---|---|---|---|
| 2,036,168 | 3/1936 | Engert et al. | 162/190 |
| 2,041,968 | 5/1936 | Schur | 162/190 |
| 2,668,111 | 2/1954 | Lindquist | 162/169 |
| 2,941,971 | 6/1960 | Thompson et al. | 524/821 |
| 3,193,446 | 7/1965 | Eisenberg | 162/169 |
| 3,256,234 | 6/1966 | Miller | 524/821 |
| 3,784,498 | 1/1974 | Ceska | 524/819 |
| 3,882,070 | 5/1975 | Ceska | 524/828 |
| 4,001,163 | 1/1977 | Matner et al. | 524/821 |
| 4,209,562 | 6/1980 | Suwala et al. | 428/271 |
| 4,265,977 | 5/1981 | Kawamura et al. | 428/511 |

*Primary Examiner*—Peter Chin

*Attorney, Agent, or Firm*—Marilyn J. Maue; Joshua J. Ward; J. Gary Mohr

[57] ABSTRACT

A carboxylated latex is added to an aqueous slurry of fibers to remove metal ions contained in solution. The water is removed to form a felt. The demetallized water removed during felt formation is recycled in a closed process water system. The carboxylated latex is formed by polymerizing an unsaturated carboxylic acid on a substantially surfactant free styrene-diene polymer latex.

6 Claims, No Drawings

WATER PURIFYING LATEX BINDER

BACKGROUND OF THE INVENTION

1. Field of the Invention

This invention relates to a method of manufacturing felts for vinyl flooring or gasketing material, and specifically to the use of a latex binder for papermaking fibers which also removes contaminating dissolved ions from the process water.

2. Brief Description of Prior Art

Chrysotile asbestos has found widespread use in the manufacture of felts for vinyl flooring and gasketing materials. The fibers of chrysotile have a cationic electrostatic charge. It is convenient to use a styrene-butadiene rubber latex, the particles of which are negatively charged, to bond the fibers into a uniform sheet. Due to the difference in electrostatic charge, the particles of latex are quantitatively adsorbed on the fibers within seconds.

Unfortunately, chrysotile contains mineral salts which dissolve in the process water during the mechanical dispersion of the fibers. As these minerals become more concentrated in the process water, the drainage of water from the asbestos stock is reduced, slowing the felt-making machinery. Fresh water must then be added to the process water. As a result, part of this process water must continually be discarded. Closing of the process water system would result in a savings of fuel and raw materials and eliminate objectionable effluents.

Fibrous substitutes for asbestos which have been proposed, such as cellulose, fiberglass, rockwool and polypropylene are relatively inert and do not readily adsorb latex particles. These asbestos substitutes must be pre-treated with agents such as alum or polymeric flocculants and/or used with mineral fillers such as kaolinite or wollastonite to promote the precipitation of latex particles in the formation of a felt. The accumulation of dissolved mineral salts in the process water will be as much a hindrance to the closure of the process water system with these asbestos-free compositions as it is with asbestos-containing felt compositions.

Conventional styrene butadiene latices used in felt-making are usually prepared in a batch polymerization. All of the monomer is in the reactor at the start of the polymerization and must be emulsified by copious amounts of surfactants. These surfactants are also needed to prevent coagulation of the latex particles during storage and handling. Adsorption of the latex particles onto asbestos in the felt-making process releases the surfactants to the process water adding to the dissolved salts originating from the mineral component. In addition, these surfactants, particularly those of non-ionic type, enter the air-water interface causing the formation of a stable foam, requiring the continuous introduction of an antifoam composition.

If it were not for the surfactants, the surface of the particles of the styrene-butadiene latices, containing copolymerized carboxylic and sulfate acid groups, would provide ion exchange capacity which would aid in the purification of process water. "Low Emulsifier" synthetic styrene-butadiene latices were prepared in a two-step polymerization in U.S. Pat. No. 3,784,498. Stability was obtained by pH adjusting the latices in the second step with ammonia to between 7 and 10. Styrene-butadiene latices prepared by a similar two-step polymerization with N-methylol acrylamide in U.S. Pat. No. 3,882,070 had a final pH of greater than 5. The pH of these latices is too high to be useful for precipitation of cationic fibers in felt manufacture and to adequately demonstrate the ion exchange capability.

SUMMARY OF THE INVENTION

It has been found that the problems of the prior art can be overcome through the use of a latex containing the least possible amount of surfactants. A polymerization process involving continuous addition of monomers is uniquely suited to preparing latices which are virtually surfactant-free. Initially, the reactor has no monomers in it to be emulsified. Carboxylic acids and the persulfate catalyst which are present, while not normally considered emulsifiers, are sufficient to stabilize the monomer droplets during a continuous monomer addition process.

The latices manufactured according to the foregoing process provide a plurality of advantages. These latices have excellent stability and freedom from foam when subjected to mechanical agitation as during pumping. Some of the characteristics required for felt manufacture, such as drainage and tensile strength, are improved when the latices of this invention are employed. Furthermore, these latices exhibit an inherent ion exchange capability as evidenced by removal of dissolved salts from the felt-making process water.

DESCRIPTION OF THE PREFERRED EMBODIMENTS

Asbestos sheets suitable for use as a substrate for vinyl flooring are generally produced with fibers ranging in length from 1/32 to ⅛ inch. Fibers with these lengths are classified by the Quebec Producers Association as Grades 5, 6 and 7. These grades and mixtures thereof are generally used in the manufacture of asbestos sheets but other fibers, e.g., cellulose, are occasionally introduced.

The desired amount of asbestos fiber, generally from 0.3 to 8% by weight of the total slurry, is added to the water. The slurry is then refined in a Hydropulper, Jordan engine, beater, disc refiner or the like. The water at this point is hot (about 38° C.) and it is recycled from the wet end of the papermaking machinery. After the fiber bundles are broken down the slurry is transferred to a tank where binder latex is added. The mixture is then formed into sheets and the sheets are then pressed and dried.

The purposes of this invention are achieved by utilizing the carboxylic acids and initiator to provide emulsification of monomer droplets during polymerization and stability of the finished latex during storage and handling. In this case, nuclei for polymerization are provided by a seed latex rather than by micelles as in batch polymerizations. While the theory behind the effectiveness of the method is not fully understood, for the purpose of completeness of disclosure, it is noted that in the continuous monomer addition polymerization process, a low molecular weight styrene-butadiene polymer having sulfate and carboxyl groups may initially be created. Such a polymer could have sufficient sulfate and carboxyl groups for it to function as a surfactant.

The seed and the binder latices used in this invention may be, in principle, a copolymer of a diolefin with 4 to 8 carbon atoms, for example: 1,3-butadiene; 1,3-dimethyl-1,3-butadiene; 1,4-dimethyl-1,3-butadiene; and isoprene, with styrene. The seed latex may be prepared with the same initiators, carboxylic acids and chelating agents which are described below as being appropriate for making the subject latex of this invention. The seed and binder latices of this invention are typically carboxylated styrene-diene latices containing from about 40 to about 70 weight percent styrene, from about 30 to about 60 weight percent of a diene monomer and from 0.5 to about 5 weight percent of a carboxylic acid monomer such as, for example, acrylic acid, methacrylic acid, fumaric or itaconic acid. Additionally, the latices can also contain initiators, chain transfer agents, preservatives and other modifiers which are well known to those skilled in the art.

The stabilization of the seed latex can be obtained with anionic surface active agents such as sodium lauryl sulfate, sodium dodecyl benzene sulfonate, sodium alkyl sulfosuccinates or alkyl phenoxy poly(ethyleneoxy)ethanols such as as octyl or nonylphenoxy poly(ethyleneoxy)ethanols, including the full range of ethylene oxide contents available. Nonionic surface active agents such as alkyl phenoxy poly(ethyleneoxy)ethanols, including the full range of ethylene oxide contents available may also be used.

The surface active agent used to stabilize the seed latex is restricted to amounts that will result in a seed latex with an average particle size of between about 0.0005 and 0.1 microns. Seeds with an average particle size of 0.01 to 0.08 are preferred. The amount of surfactant stabilizer which will result in seed particles within the specified size range is from about 0.5 to about 4% by weight depending on the amount of initiator used.

Continuous monomer addition, when used in the preparation of the seed latex, results in smaller particles than would result from a batch process with the same amount of surfactants. Initially, the reactor contains the aforementioned surfactants, water and optionally buffers, chain transfer and chelating agents. This solution is brought up to a temperature of between 160° and 210° F., preferably between 175° and 190° F. A solution of the initiators, a detailed description of which appears below, is mixed into the hot surfactant solution. A mixture of styrene, diene monomer and unsaturated carboxylic acid is pumped into the reactor at a rate that will bring about complete addition of the monomer with 2½ hours. The reaction mixture is kept at this temperature for 2 hours longer. A preservative may be added if the seed latex is to be stored for any length of time.

Continuous monomer addition, when applied to the preparation of binder latices, results in reduced amounts of surfactant and, consequently, higher surface tension of the finished latex. A carboxylic acid, chelating agent, seed latex and chain transfer agent are charged to a stirred reactor. The reactor is heated to temperatures as described for the making of seed latex, typically 180° F. Seed latex can be used in an amount such that the seed solids comprises from about 0.05 to about 8 percent of the weight of polymer in the binder latex. A solution of initiator in water is charged to the reactor contents at 180° F. Styrene, a diene monomer and unsaturated carboxylic acid monomer are blended in a separate tank, referred to as a monomer tank. Initiator, a small amount of hydroxide base and water are mixed in an aqueous tank. The contents of the monomer tank and the aqueous tank are simultaneously and uniformly fed to the reactor continuously over a four hour period. The reaction is then continued for two hours at 190° F. The reactants are cooled, discharged and stripped with a chemical stripping formulation which consists of 0.1% t-butyl hydroperoxide, 0.1% erythorbic acid and 0.01% ferrous sulfate.

Sources of radicals to initiate the polymerization of the latices of this invention can be selected from any of the initiators known in the art including those which undergo scission by heating or reaction with reducing agents. Water-soluble type initiators are preferred including sodium persulfate, potassium persulfate, ammonium persulfate, hydrogen peroxide and others which are familiar to those skilled in the art. The amount of initiator used may range from about 0.1 percent to about 4.0 percent of the polymer weight depending on the rate of polymerization desired. The initiator, and the redox agent if used, can be supplied to the aqueous composition in various ways. For example, the entire amount an aqueous solution initiator used can be added at the beginning of the polymerization, or an initial portion can be followed by a continuous or addition of portions of the remainder during the reaction, or the entire amount can be added continuously throughout the period of the reaction. The seed latex typically requires about twice the amount of initiator needed for the binder latex of this invention. When reducing agents are used it is again preferred to use water-soluble materials such as sodium metabisulfite, sodium hydrosulfite and ascorbic acid.

Unsaturated carboxylic acids useful in the manufacture of the latices of this invention are those which have the formula:

$$\underset{R_1}{\underset{|}{CH}}=\underset{R_2}{\underset{|}{C}}-COOH \qquad (I)$$

This includes $\alpha,\beta$-ethylenically unsaturated monocarboxylic acids where $R_1$ is hydrogen and $R_2$ can be hydrogen, methyl, ethyl or like alkyl groups as in acrylic, methacrylic, and ethacrylic acids, respectively. Ethylenically unsaturated dicarboxylic acids where $R_1$ is a carboxyl group and $R_2$ is hydrogen in formula I such as maleic and fumaric acid, may also be selected. Ethylenically unsaturated dicarboxylic acids where $R_1$ is hydrogen and $R_2$ is a methylene carboxylic acid group in formula I, such as itaconic acid, can also be selected. The latices of this invention may contain from about 0.5 to about 15 percent of polymer weight of an unsaturated carboxylic acid, preferably from 3 to 6 percent.

Chain transfer agents can be used to regulate the average molecular weight of the polymer. Preferred agents are mercaptans such as t-dodecylmercaptan.

The aqueous solutions of this invention may contain small amounts of water-soluble compounds to maintain the pH of the solution at desired levels. Such compounds include alkali metal or ammonium salts or bases such as sodium or potassium carbonate, sodium bicarbonate, trisodium phosphate, sodium citrate, ammonium or potassium hydroxide and the like.

Latices for asbestos felts are evaluated by preparing hand sheets and subjecting them to conventional paper testing. A blend of 25 parts of Quebec grade 5 and 75 parts of Quebec grade 7 asbestos is dispersed in water (38° C.) to about a 5% consistency. The slurry is agitated using a 2.5 inch split disc impeller at 1000 rpms for 8 minutes. Sufficient latex is added to give 15 parts of polymer in 100 parts of asbestos and the stirring continued for 7 minutes. The resulting slurry is uniform and homogeneous and suitable for forming sheets in a Williams sheet mold after being diluted to a 3% consistency. The sheets are then pressed on a Williams hydraulic press and dried on the Williams standard sheet dryer.

Water (35° C.) is added to the stock to bring the consistency to 2%. The drainage of water from the asbestos slurries is measured with a Schopper-Riegler freeness tester. Low numbers indicate fast drainage.

The tensile strengths are determined by pulling 1 inch strips of the sheet on an Instron 1130 test instrument at a crosshead speed of 2 in/min. A cold test is done at room temperature (21° C.); a hot test is done by heating the strip to 190° C.; a plasticizer tensile is run after the sample is soaked for 18 hours in butyl benzyl phthalate to simulate the plasticizers which may be used in some vinyl coatings in flooring manufacture.

For a fuller understanding of the nature and objects of this invention, reference may be made to the following examples. These examples are given merely to illustrate the invention and are not to be construed in a limiting sense.

EXAMPLE 1

This example illustrates the preparation of a seed latex.

A clean stirred pressure vessel was charged with 1020.0 grams of deionized water, 62.3 grams of a 25% solution of Siponate DS-10 (trademark of Alcolac, Inc.), 1.95 grams of sodium bicarbonate and 0.6 grams of a 42% solution of Hampene 100 (an EDTA chelating agent). The mixture was stirred and the reactor was heated to the polymerization temperature of 176° F. At 176° F., solution of 7.1 grams of ammonium persulfate catalyst in 55 grams of deionized water was charged to the reaction vessel. The monomer mixture, 389.5 grams of styrene and 389.5 grams of butadiene, was pumped into the reactor at a constant rate over a period of 2.5 hours. The reaction temperature of 176° F. was maintained for 2 hours longer.

EXAMPLE 2

This example illustrates the preparation of a binder latex.

A clean stirred pressure reactor was charged with 945.0 grams of deionized water, 100 grams of the seed latex of Example 1, 31.7 grams of fumaric acid, 4.7 grams of Hampene 100 and 3.0 grams of dodecyl mercaptan. Temperature of the mixture was increased to 180° F. while agitating the reaction mixture. At 180° F., a solution of 1.2 grams of ammonium persulfate in 50 grams of deionized water was added to the reactor. A monomer mixture of 704.0 grams of styrene, 468.0 grams of butadiene, 14.8 grams of methacrylic acid and 4.2 grams of dodecyl mercaptan was prepared. A catalyst mixture of 5.4 grams of ammonium persulfate and 200.0 grams of deionized water was prepared. The catalyst and the monomer mixtures were both pumped continuously to the reactor at a rate such that the mixtures were both completely added in a period of 4 hours. The pressure in the reactor did not exceed 100 psi during the polymerization. After the temperature had been maintained at 190° F. for 2 more hours, chemical stripping additives, 3 grams of t-butyl hydroperoxide (70%) and 7 grams of isopropyl alcohol, were added followed by the addition of 10 grams of erythorbic acid (5% solution). After one additional hour at 190° F., the reaction mixture was cooled to ambient temperature.

This latex had a solids content of 49.0%, only 0.2% coagulum, a pH of 2.65 and a surface tension of 63.8 dyne $cm^{-1}$. The last two characteristics, low pH and high surface tension, allow the full development of the ion exchange capability of this type of latex.

The particle size of latices made according to this invention ranged from 0.12 to 0.25 microns with an average of 0.16 microns. The ionic groups which are bound to the surface of the polymer particle provide less than 0.7 milliequivalent of charge per gram of polymer in the latex. It is preferred that the binder latex of this invention have a charge bound to the polymer of from about 0.2 to 0.4 milliequivalents per dry gram. These "bound charges" originate from the copolymerization of a monomer containing an ionizable group, such as a carboxylic acid, or from the incorporation of the initiating sulfate groups into the polymer, such as from the persulfate catalyst. These ionizable groups are "bound to the polymer" in the sense that they are not desorbed from the polymer particle upon dilution or mechanical shear. Thus, the bound charges provide latex stability, sites for bonding the polymer particle onto asbestos on other mineral fillers and the added capability of scavenging metallic ions from the aqueous phase. These and other capabilities of the latex of this invention will be amply demonstrated in the following examples.

EXAMPLE 3

A drum of high ionic strength process water was obtained from an asbestos felt mill. A pair of hand sheets were prepared according to the aforementioned procedure with the latex of Example 2. The water drained from the hand sheets was collected and sparged with nitrogen for 5 minutes at 24° C. to remove dissolved gases. The conductivity of the collected process water was measured with a cell whose constant was 0.61 $cm^{-1}$. Another pair of hand sheets was prepared with the process water collected from the preceding pair, the procedure being repeated until five pairs of hand sheets were made. In FIG. 1, the lower line shows a gradual decrease in specific conductance, for a total 9% decrease after 4 pairs of hand sheets had been made. Hand sheets were made with a conventional felt latex, GAF 400-76E, without benefit of the continuous monomer addition method of this invention. The upper line in FIG. 1 illustrates the increase in specific conductance—6% after 5 pairs of hand sheets—encountered with a conventional batch polymerized type of latex.

EXAMPLE 4

A slurry of asbestos fibers, 4 part Johns Manville 7M57 to 1 parts of Paperbestos 5, was prepared at 10 percent consistency in a Black Clawson Hydrapulper. The slurry is pumped to a batch chest where the latex of Example 2, diluted to 10% solids, was added. The amount of polymer was 12.8 percent of fiber by weight.

The resulting stock is pumped through the stock value where white water from the later stages of the process is returned to the system between the stock valve and the fan pump so that the consistency is maintained at 3.5% in the headbox. The furnish from the headbox is fed onto a 4 meter wide plastic Fourdrinier wire moving at 125 feet per minute. As soon as the stock containing the latex of Example 2 arrived at the machine the drainage improved so that one half of the suction boxes were turned off and the speed increased to 131 feet per minute.

The conductivity of the process water was 3650 micromhos at the beginning of Example 4 since the system was closed. After the machine had been running for 10 hours, the conductivity was decreased to 3300 micromhos. Samples of process water were taken at about one hour intervals during this time and analyzed by Atomic Absorption Spectroscopy. The metallic ions contributing to the conductivity of the process water are shown in FIG. 2. Significant decreases in the concentration of magnesium, sodium and calcium ions were observed. These ions were replaced with potassium in an ion exchange process in which the insoluble acidic polymeric ion exchange resin is the binder latex particle, an integral part of the moving fibrous felt.

Within 6 hours after the stock containing the latex of Example 2 was replaced by stock containing a conventional batch polymerized latex the conductivity had increased to 3600 micromhos.

The physical properties of felts produced during the course of Example 4 are summarized in Table 1.

TABLE 1

| | Before | Example 4 | After |
|---|---|---|---|
| Latex (%) | 13.5 | 12.8 | 14.3 |
| Density (lb/ft$^3$) | 63.4 | 62.1 | 63.2 |
| Cold Tensile (lb/in) | 54.8 | 50.7 | 53.2 |
| Hot Tensile (lb/in) | 22.5 | 26.0 | 22.0 |
| Smoothness, felt side | 466. | 506. | 460. |
| wire | 893. | 961. | 939. |

The hot tensile strength was noticeably higher and the density was lower during Exhibit 4 than with the conventional latex (Before and After). Both of these properties are beneficial to felt usage. The other felt properties, strength and smoothness, were equal to those with conventional latex.

What we claim is:

1. In a process for the manufacture of felts from slurries of fibers containing water-soluble metal salts, the steps consisting essentially of:
   (a) forming an aqueous slurry of said fibers containing metal ions in solution;
   (b) forming a substantially surfactant-free polymer latex by copolymerizing styrene and a diene monomer, optionally substituted with methyl, in the presence of a persulfate catalyst at a strongly acid pH;
   (c) adding to said latex an unsaturated carboxylic acid, maintaining said strongly acid pH and polymerizing said carboxylic acid on the surface of said latex in an amount of at least about 0.5% by weight of said polymer;
   (d) adding the acidic, carboxylated latex of step (c) to said slurry with agitation in an amount sufficient to bind said metal ions by ion exchange;
   (e) mixing the slurry of step (d) for a period sufficient to effect ion exchange between the carboxylated latex and the metal ions in said slurry to demetalize the water of said slurry;
   (f) removing water from said fibers and said latex in said slurry to form a felt and
   (g) recycling said demetalized water to step (a) to provide the dilution required for slurry formation in a closed-process water system.

2. The method of claim 1, wherein said fiberous material is asbestos.

3. The method of claim 1, wherein said fiberous material is an inert fiber selected from the group consisting of cellulose, fiberglass and rock wool.

4. The method of claim 1, wherein said diene is butadiene.

5. The method of claim 1, wherein said diene monomer is isoprene.

6. The method of claim 1, wherein said carboxylic acid monomers are represented by the formula:

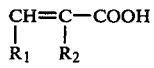

$R_1$ is hydrogen, a carboxyl group or a carboxyl containing group; and $R_2$ is hydrogen, an alkyl group, a carboxyl or a carboxyl containing group.

* * * * *